US006671899B1

(12) United States Patent
Oja

(10) Patent No.: US 6,671,899 B1
(45) Date of Patent: Jan. 6, 2004

(54) PERSON LIFTING STRAP

(76) Inventor: Jeffrey E. Oja, 491 S. 200 East, Kaysville, UT (US) 48037-2596

( * ) Notice: Subject to any disclaimer, the term of this patent is extended or adjusted under 35 U.S.C. 154(b) by 0 days.

(21) Appl. No.: 10/176,316

(22) Filed: Jun. 20, 2002

(51) Int. Cl.[7] ..... A61G 7/10
(52) U.S. Cl. ..... 5/89.1; 5/81.1 T
(58) Field of Search ..... 5/81.1 R, 89.1, 5/81.1 T

(56) References Cited

U.S. PATENT DOCUMENTS

| | | | | | |
|---|---|---|---|---|---|
| 3,275,205 | A | | 9/1966 | Howd et al. | |
| 3,295,520 | A | | 1/1967 | Keller | |
| 3,458,878 | A | | 8/1969 | Combs | |
| 3,859,677 | A | | 1/1975 | Nordwig | |
| 4,159,010 | A | * | 6/1979 | Mitro | 5/89.1 |
| 4,442,557 | A | | 4/1984 | Clemens | |
| 4,723,327 | A | | 2/1988 | Smith | |
| 4,782,539 | A | * | 11/1988 | Elliott | 5/89.1 |
| 4,944,057 | A | | 7/1990 | Shaw | |
| 5,121,756 | A | * | 6/1992 | Koledin | 5/628 |
| 5,269,324 | A | | 12/1993 | Butterfield | |
| 5,297,834 | A | | 3/1994 | Vanarnem | |
| 5,383,711 | A | * | 1/1995 | Houghteling | 297/397 |
| 5,396,670 | A | * | 3/1995 | Firebaugh et al. | 5/89.1 |
| 5,530,975 | A | * | 7/1996 | Firebaugh et al. | 5/81.1 T |
| 5,579,546 | A | | 12/1996 | Griskauskas | |
| 5,711,044 | A | | 1/1998 | Newman et al. | |
| 5,878,450 | A | | 3/1999 | Bouhuijs | |
| 5,963,995 | A | | 10/1999 | Glass | |
| 6,073,280 | A | | 6/2000 | Farnum | |
| 6,122,778 | A | | 9/2000 | Cohen | |
| 6,154,900 | A | | 12/2000 | Shaw | |
| 6,174,010 | B1 | | 1/2001 | Fanger et al. | |
| 6,175,973 | B1 | | 1/2001 | Hakamiun et al. | |
| 6,190,342 | B1 | | 2/2001 | Taylor | |
| 6,196,229 | B1 | | 3/2001 | Piazza | |
| 6,216,636 | B1 | | 4/2001 | Butchko | |
| 6,219,862 | B1 | | 4/2001 | Horcher et al. | |
| 6,223,365 | B1 | | 5/2001 | Liljedahl | |
| 6,276,006 | B1 | | 8/2001 | Hoit | |
| 6,289,534 | B1 | | 9/2001 | Hakamiun et al. | |
| 6,449,785 | B1 | * | 9/2002 | Liljedahl | 5/89.1 |
| 6,581,222 | B1 | * | 6/2003 | Liljedahl | 5/89.1 |

* cited by examiner

*Primary Examiner*—Robert G. Santos
(74) *Attorney, Agent, or Firm*—Jones, Waldo, Holbrook & McDonough; Brent T. Winder

(57) ABSTRACT

A lifting device made of a single piece of a flexible material, substantially forming a loop, is disclosed. The flexible material has a first and second edge, a fold between the first and second edge, such that the first edge rests substantially atop the second edge, and a seam securing the first edge to the second edge. A first handle is formed by a first end of the loop, and a second handle is formed by a second end of the loop, opposite the first end of the loop. A flexible support piece is coupled substantially within the loop, between the first and second end of the loop. A method of using a person lifting device is also disclosed. The first step of the method is to provide a lifting device. The lifting device includes a single piece of a flexible material, substantially forming a loop. The single piece of flexible material has a first and second edge, a fold between the first and second edge, such that the first edge rests substantially atop the second edge, and a seam securing the first edge to the second edge. The lifting device also includes a first handle, formed by a first end of the loop and a second handle, formed by a second end of the loop, opposite the first end of the loop. There is also a flexible support piece coupled substantially within the loop, between the first and second end of the loop. Next, the support piece is inserted substantially beneath the person to be lifted. The first and second handles are grasped and a substantially upward pulling force is exerted on the first and second handles. In this manner the person is lifted.

16 Claims, 6 Drawing Sheets

PERSON LIFTING STRAP

FIELD OF THE INVENTION

The present invention relates generally to devices for lifting individuals, and more particularly to a lifting device that allows emergency medical personnel to assist a person of large stature in resuming a standing position, that minimizes the occurrence of connecting points and seams, and is consequently stronger, and is also small, lightweight and conveniently stored and transported.

BACKGROUND

Oftentimes, in the field of emergency medicine, emergency medical personnel are called upon to assist persons of large stature who have fallen and are unable to return to a standing position without assistance. In attempting to help lift such individuals, frequently emergency medical personnel will try to grasp the fallen individual under the arms, and pull the person up. However, such an approach is not effective, and is a source of potential injury to the fall victim and to the rescuer.

For example, by pulling a large individual up by his arms, there is a good likelihood that the pulling force could dislocate the fall victim's shoulders. Moreover, in some circumstances, when emergency medical personnel attempt to lift a fall victim by his arms, there is a greater likelihood that the emergency medical personnel will lose their grip and the individual will fall again, potentially resulting in further injury.

Additionally, when lifting large individuals, a proper lifting stance is very important to avoid injury on the part of the rescuer. Specifically, improper lifting positions can result in serious back injuries to the rescuer.

Therefore, a lifting device that allows emergency medical personnel to assist a person of large stature in resuming a standing position, while maintaining proper lifting stance, would be advantageous to fall victims as well as to rescuers.

It is noted that, in a lifting device, and especially in a lifting device for fall victims, the strength of the lifting device is a very important consideration. Failure of the device during a lift could be disastrous. A number of things can contribute to a lifting device's failure. For example, if a lifting device is made of a structurally weak material, there is an increased likelihood that the device will fail in operation. Flaws in construction of the device could also result in failure, regardless of the materials used.

As the saying goes, "a chain is only as strong as its weakest link." In the context of lifting devices, the "weakest link" is almost invariably to be found at the connecting point of two separate pieces or along the seams. Therefore, a lifting device that minimized the occurrence of connecting points and seams would be stronger, and therefore advantageous.

Additionally, the situations in which emergency medical personnel are called upon to help a person stand are frequently tight conditions such as in bathrooms. A lifting device that is large or cumbersome would not be well-suited for such conditions. Moreover, a device that is large or otherwise cumbersome would be difficult to transport around. Therefore, given the time sensitivity of many emergency medical service (EMS) responses, a lifting device that is also small, lightweight and conveniently stored and transported would be advantageous.

A variety of U.S. patents disclose various devices and methods related to person lifting devices. For example, U.S.

Pat. No. 6,276,006 to Hoit discloses an apparatus and method for moving an airline passenger whereby a Tyvek® sling having handles attached thereto is buckled about an airline passenger and then the passenger is lifted and transferred, by two or more persons grasping the handles, from a wheelchair on the aircraft into an adjacent seat.

U.S. Pat. No. 6,122,788 to Cohen discloses a lift vest that enables a care-giver to assist a patient in moving from one position to another.

U.S. Pat. No. 6,073,280 to Farnum discloses a rescue and invalid support belt.

U.S. Pat. No. 5,963,995 to Glass discloses a support device which is designed to be worn by a person to aid in movement and transfer of such person. The unit is formed so that, when being worn by the user, lateral handle areas are available for lifting or moving the person. The overall shape of the design provides support and comfort for the wearer.

U.S. Pat. No. 5,579,546 to Griskauskas discloses a device for moving a disabled person that utilizes the substantially rectangular-shaped canvas lift sling of the Hoyer lift for safely transferring an individual a limited distance. The device for moving a disabled person includes two pair of hand grips. Each of the two pair of hand grips is removably hookable in each of the pair of spaced apart lift apertures of each of the pair of longitudinal edges of the substantially rectangular-shaped canvas lift sling of the Hoyer lift.

U.S. Pat. No. 3,859,677 to Nordwig discloses a substantially rectangular sheet of flexible material having longitudinally aligned loops formed along opposite edges for receiving a pair of rigid, elongated handles.

U.S. Pat. No. 3,458,878 to Combs discloses a device for use in moving a bed patient, including an elongated main strap fitted with a buckle at one end thereof, said one end being securable to the side rail of a hospital bed.

U.S. Pat. No. 5,297,834 to Vanarnem discloses a method and apparatus for lifting and transferring a disabled person to and from a wheel chair. The apparatus includes an elongated sheet of material having handles at each end.

U.S. Pat. No. 4,442,557 to Clemens discloses a carrier apparatus for use by fire fighters to carry fire hose, and to serve as a personnel carrier.

U.S. Pat. No. 4,723,327 to Smith discloses a device to transport and move bed ridden patients easily and securely without potential injury to either the patient or the attendant.

U.S. Pat. No. 4,944,057 to Shaw discloses a device to assist in lifting and supporting a handicapped or infirm person from a sitting position on a supporting surface, and transferring the person to a sitting position on a second supporting surface.

U.S. Pat. No. 5,269,324 to Butterfield discloses a device for raising a patient's upper body off the surface of an underlying support to insert a chest board between the back of the patient and the underlying support.

U.S. Pat. No. 5,711,044 to Newman, et al. discloses a person transfer assist device to help a person transfer from a sitting position to a standing position and from a standing position to a sitting position.

U.S. Pat. No. 6,175,973 to Hakamiun, et al. discloses an apparatus for assisting a person in achieving a standing position.

U.S. Pat. No. 3,275,205 to Howd, et al. discloses a reinforced strap, made of high strength nylon webbing, or some other suitable strong and lightweight material, which is looped together in a certain designated pattern and stitched for the purpose of making loops and handles.

U.S. Pat. No. 6,196,229 to Piazza discloses a patient mobilizer for enabling a care giver to move a generally disabled patient.

U.S. Pat. No. 6,216,636 to Butchko discloses a device for assisting four-legged pets to walk during periods of convalescence from foot, leg, or hip surgery or injury.

Each of the foregoing patents is hereby incorporated by reference for its supporting teachings.

While these patents demonstrate improvement in their respective areas, none adequately provide a lifting device that allows emergency medical personnel to assist a person of large stature in resuming a standing position, that minimizes the occurrence of connection points and seams, and is consequently stronger, and is also small, lightweight, and conveniently stored and transported.

SUMMARY OF THE INVENTION

There is, therefore, provided a lifting device made of a single piece of a flexible material, substantially forming a loop. The flexible material has a first and second edge, a fold between the first and second edge, such that the first edge rests substantially atop the second edge, and a seam securing the first edge to the second edge. A first handle is formed by a first end of the loop, and a second handle is formed by a second end of the loop, opposite the first end of the loop. A flexible support piece is coupled substantially within the loop, between the first and second end of the loop.

A method of using a person lifting device is also provided. The first step of the method is to provide a lifting device. The lifting device includes a single piece of a flexible material, substantially forming a loop. The single piece of flexible material has a first and second edge, a fold between the first and second edge, such that the first edge rests substantially atop the second edge, and a seam securing the first edge to the second edge. The lifting device also includes a first handle, formed by a first end of the loop and a second handle, formed by a second end of the loop, opposite the first end of the loop. There is also a flexible support piece coupled substantially within the loop, between the first and second end of the loop. Next, a support section of the device is inserted substantially beneath the person to be lifted. The first and second handles are grasped and a substantially upward pulling force is exerted on the first and second handles. This substantially upward pulling force is translated to the support section, causing a substantially upward force to be exerted on the person to be lifted. In this manner the person is lifted.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

BRIEF DESCRIPTION OF THE DRAWINGS

FIG. 4(*b*) is a break-away view of the loop connector shown in FIG. 4(*a*).

DETAILED DESCRIPTION OF THE PREFERRED EMBODIMENT(S)

The presently preferred embodiments of the invention will be best understood by reference to the drawings, wherein like parts are designated with like numbers throughout.

Figure 1:
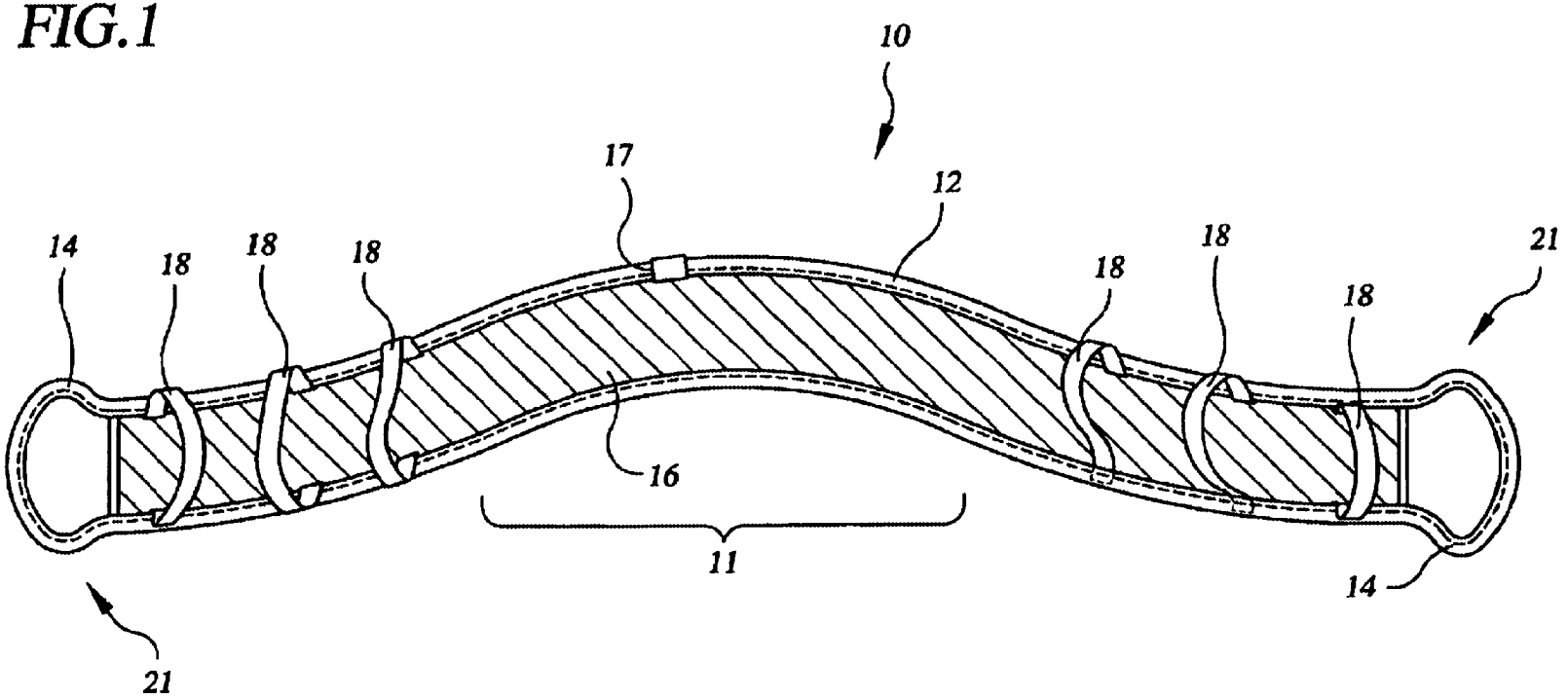
FIG. 1 is an embodiment of a person lifting device according to the present invention.

FIG. 1 shows an embodiment of a person lifting device 10. The device 10 is made of a looped piece 12 a flexible material. The loop 12 is formed by joining the ends 19 (FIG. 4) of the flexible material at a connector 17. The ends 21 of the loop 12 form a first set of handles 14. Substantially within the loop 12 is a piece of flexible support material 16. Additional handles 18 are also coupled to the loop 12. The support section 11 is the general portion of the lifting device 10 that is inserted under a fall victim. In this embodiment, the support section 11 is located between the right-side and left-side additional handles 18.

Figure 2:
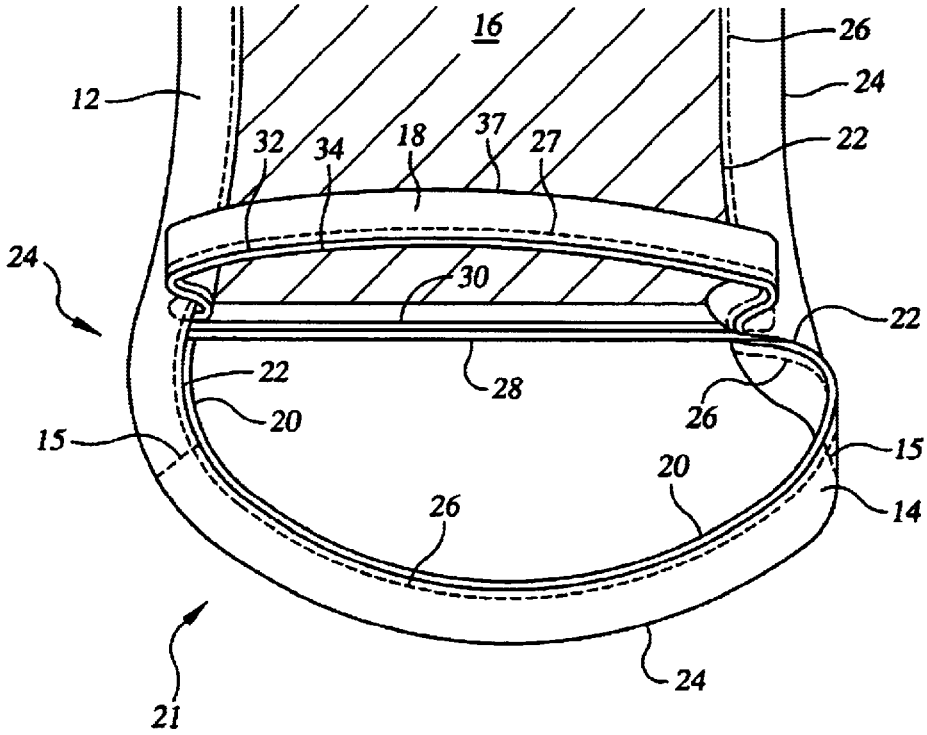
FIG. 2 is a more detailed, partial view of the lifting device of FIG. 1.

As best seen in FIG. 2, the loop 12 is formed from a single piece of material. The material is folded 24 such that the first edge 22 of the material rests substantially atop the second edge 20 of the material. The first 22 and second edges 20 are secured together with a seam 26. In the present embodiment, the seam 26 is a single continuous stitch.

The flexible support material 16 is coupled to the loop 12 along the seam 26. The flexible support material 16 can be a single ply or, as seen in FIG. 2, can have multiple plies 28, 30.

The handles 14, formed by the ends 21 of the loop 12, can include a piece of rope, or some other substantially flexible support piece 31 (FIG. 6), within the fold 24. The support piece 31 helps to round out the handle 14, which makes gripping the device 10 more comfortable. The support piece 31 also helps the handle 14 retain its shape, which makes the handle 14 more readily accessible by the user. In the present embodiment, the support piece 31 is secured within the handle 14 by the inclusion of stitches 15.

Figure 3:
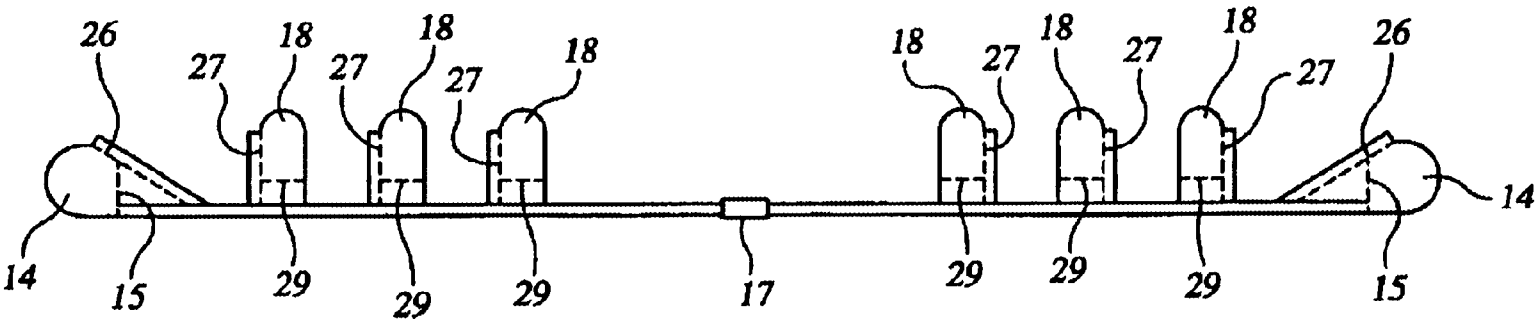
FIG. 3 is side-view of the lifting strap of FIG. 1.

As seen in FIGS. 2 and 3, the additional handles 18 can be a single piece of material folded such that a first edge 32 of the material rests substantially atop a second edge 34, and the two edges 32, 34 are secured together by a seam 27. As with handles 14, the additional handles 18 can include a piece of rope or other substantially flexible support piece in the fold 37. The support piece can similarly be secured within the handle 18 by the inclusion of stitches 29 (FIG. 3).

It is noted that the inclusion of additional handles 18 allows a rescuer to align his back in a proper lifting position, thus reducing the chance of back injury. It is also noted that the inclusion of additional handles allows users of varying height to utilize the present invention. For example, in some circumstances, the primary handles being pulled will be the handles 14 located at the ends of the device 10. However, when shorter individuals are utilizing the device 10, it may be necessary for them to grasp the inner handles 18 in order to obtain the desired leverage.

Figure 4A:
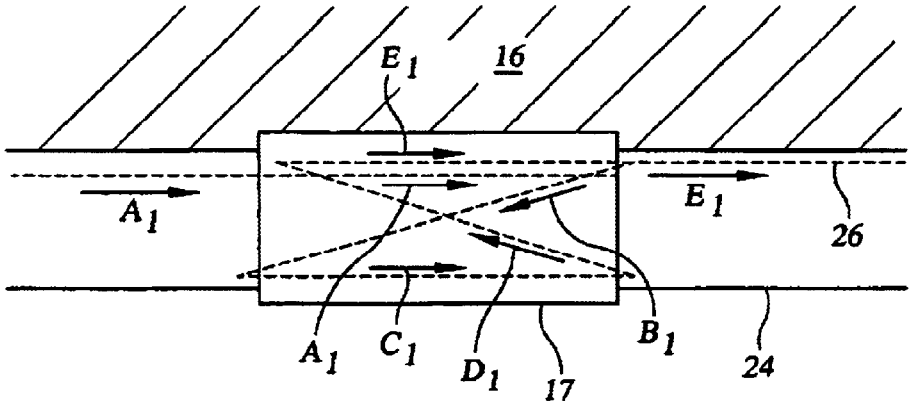
FIG. 4(*a*) is a more detailed view of the loop connector.
Figure 4B:
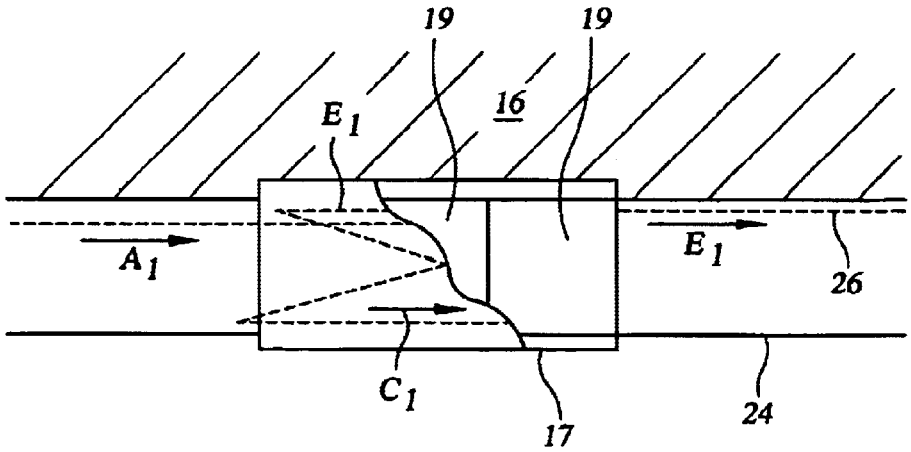

FIGS. 4(*a*) and (*b*) provide a more detailed view of the loop connector 17. The loop connector 17 is a reinforcing piece of material placed at the joining ends 19 of the flexible material, making the loop 12 less susceptible to breaking. The loop connector is secured along the seam 26. In FIGS. 4(*a*) and (*b*), the seam 26 is a single stitch which runs horizontally, indicated by arrow ($A_1$), across a portion of the connector 17. The stitch then is directed in a zig-zag pattern, as indicated by arrows ($B_1$) through ($D_1$), ultimately resuming a horizontal direction ($E_1$). It is also noted that, additional passes of stitching can be made as desired. For example, the connector 17, or the entire loop 12, could be stitched a second or third time as desired.

An advantage of using a single, folded piece of material to create the loop 12, is that such a design minimizes the number of connection points and seams along the loop 12—which are most prone to failure. Specifically, under the present invention, there is only one connecting point on the loop 12—between the ends 19 of the material. Additionally, the fold 24 imparts two-plied strength to the loop 12 with only one seam 26.

Figure 5:
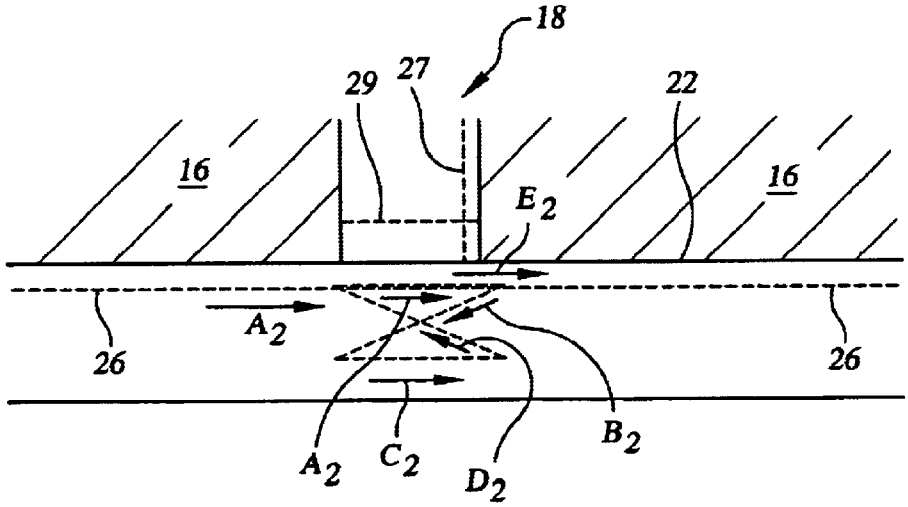
FIG. 5 is a more detailed view of the handle connection.

FIG. 5 shows a more detailed depiction of an additional handle 18 connection. A first end of the handle 18 is inserted between the first 22 and second 20 edges of the flexible material, and secured by the seam 26. The seam-26, which in this case is a single stitch, runs horizontally across the inserted portion of the additional handle 18, as indicated by arrow ($A_2$). The stitch is then directed in a zig-zag pattern, as indicated by arrows ($A_2$) through ($D_2$), ultimately resuming a horizontal direction, as indicated by arrow ($E_2$). The second end of the handle 18 is secured in a similar manner. Again, it is noted that additional passes of stitching can be made as desired.

It is further noted that the use of single stitching has manufacturing advantages. Specifically, a single, continuous stitch allows the device to be sewn in one continuous motion. Such single stitching also imparts greater strength to the device 10.

It is also noted that, in the embodiments shown in FIGS. 1–3, the seams 27 on the additional handles 18 are oriented such that when a user is pulling in a substantially upward direction, the fold 37, rather than the seam 27 is pressed into the users flesh. This seam configuration makes for greater pulling comfort—especially when exceptionally large people are being lifted.

Figure 6:
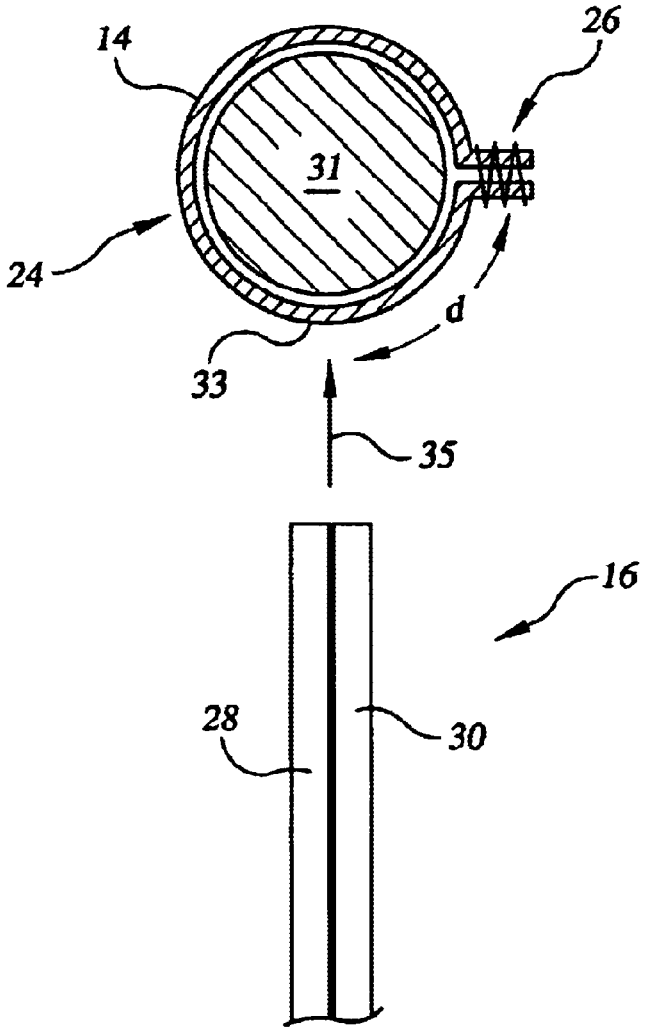
FIG. 6 is a cross-sectional view showing the relative orientation of the handle seam.

As seen in FIG. 6, the seam 26 on handles 14 is also oriented to provide the greatest structural integrity to the device 10. Specifically, when the device 10 is being used to lift an individual, the main point of applied force 33 occurs at a bottom point on the handle 14, where the user's hands will be pulling in a substantially upward direction (as indicated by arrow 35). By staggering the seam 26 relative to the main point of applied force 33, the strain on the seam 26 is minimized, and thus the structural integrity of the device 10 is maximized.

It is noted that the staggering distance (d) is preferably about 90 degrees relative to the main point of applied force 33. However, it is envisioned that distance (d) could be anywhere between one and 359 degrees relative to the main point of applied force.

In the present embodiment, nylon webbing is the material used for the loop 12 and connector 17. The flexible support material 16 is acrylic impregnated polyester. Bonded polyester thread is used in the stitching. However, it is noted that numerous other materials of suitable strength and flexibility that would be apparent to one skilled in the art could be used with the present invention.

In operation, the user(s) will insert the support section 11 substantially beneath the person to be lifted. The user(s) will then grasp the handles 14 and pull in a substantially upward direction. If needed, additional handles 18 can similarly be grasped by user(s) and likewise pulled in a substantially upward direction. The substantially upward pulling force is thus translated to the support section 11, which force lifts the fall victim. In this manner, a person of large stature, who has fallen, can be helped in resuming a standing position.

It is again noted that the inclusion and orientation of the additional handles 18 allows the user(s) to maintain proper lifting position. Thus, the fall victim can be assisted with minimized risk of back injury to the rescuer due to improper lifting position.

VARIATIONS OF THE INVENTION

In addition to any previously indicated variations, numerous other modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, form, function, manner of operation and use may be made without departing from the principles and concepts set forth herein.

For example the handle insert, or support piece 31 in the handles 14 and additional handles 18, could also be a type of padding, for added gripping comfort.

The seams 26, 27 in the preferred embodiment are stitched thread. However, the term "seam" is envisioned to include any means of bonding the materials together, including, but not limited to, stitched thread, staples, heat-bonded materials and adhesives.

The stitching at the loop connector 17 and the handle connecting points, as seen in FIGS. 4(*a*), 4(*b*) and 5 is a zig-zag pattern. However, it is noted that the present invention is not considered to be limited to any particular stitching pattern. Virtually any stitching pattern could be applied that would provide adequate strength to the present lifting device 10.

What is claimed is:

1. A person lifting device, comprising:

a) a single piece of a flexible material, substantially forming a loop, and having:

i) a first and second edge;

ii) a fold between the first and second edge, such that the first edge rests substantially atop the second edge; and iii) a seam securing the first edge to the second edge;

b) a first handle, formed by a first end of the loop, wherein the first handle further comprises a substantially flexible handle insert positioned in the fold;

c) a second handle, formed by a second end of the loop, opposite the first end of the loop; and d) a flexible support piece coupled substantially within the loop, between the first and second end of the loop.

2. The device of claim 1, wherein the flexible support piece is coupled to the loop within the seam.

3. The device of claim 1, wherein the flexible support piece is multi-plied.

4. The device of claim 1, wherein the loop is formed by coupling a first and second end of the flexible material with a loop connector.

5. The device of claim 1, wherein the seam on the first handle is staggered about ninety (90) degrees relative to a main point of applied force on the first handle.

6. The device of claim 1, further comprising one or more additional handles, coupled to the loop, between the first and second end of the loop.

7. The device of claim 1, wherein the seam is a single stitching.

8. The device of claim 1, wherein the seam is an adhesive.

9. A method of lifting a person, comprising the steps of:

a) providing a lifting device, including:

i) a single piece of a flexible material, substantially forming a loop, and having:

a first and second edge;

a fold between the first and second edge, such that the first edge rests substantially atop the second edge; and a seam securing the first edge to the second edge;

ii) a first handle, formed by a first end of the loop, wherein the first handle further comprises a substantially flexible handle insert positioned in the fold;

iii) a second handle, formed by a second end of the loop, opposite the first end of the loop; and iv) a flexible support piece coupled substantially within the loop, between the first and second end of the loop;

b) inserting a support section of the lifting device substantially beneath the person;

c) grasping the first and second handles; and d) exerting a pulling force on the first and second handles in a substantially upward direction, such that the person is lifted.

10. The method of claim 9, wherein the flexible support piece is coupled to the loop within the seam.

11. The method of claim 9, wherein the flexible support piece is multi-plied.

12. The method of claim 9, wherein the loop is formed by coupling a first and second end of the flexible material with a loop connector.

13. The method of claim 9, wherein the seam on the first handle is staggered about ninety (90) degrees relative to a main point of applied force on the first handle.

14. The method of claim 9, further comprising the step of grasping one or more additional handles, coupled to the loop, between the first and second end of the loop.

15. The method of claim 9, wherein the seam is a single stitching.

16. The method of claim 9, wherein the seam is an adhesive.

* * * * *